US009916944B2

(12) United States Patent
Koyama et al.

(10) Patent No.: US 9,916,944 B2
(45) Date of Patent: Mar. 13, 2018

(54) CONTACT MECHANISM HAVING MOVABLE CONTACT PIECES, TRIGGER SWITCH AND ELECTRIC TOOL WITH SAME

(71) Applicant: OMRON Corporation, Kyoto-shi, Kyoto (JP)

(72) Inventors: Taiki Koyama, Okayama (JP); Minoru Kobayashi, Okayama (JP); Akihiro Hozumi, Okayama (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/117,746

(22) PCT Filed: Aug. 6, 2014

(86) PCT No.: PCT/JP2014/070778
§ 371 (c)(1),
(2) Date: Aug. 10, 2016

(87) PCT Pub. No.: WO2015/122035
PCT Pub. Date: Aug. 20, 2015

(65) Prior Publication Data

US 2016/0365202 A1 Dec. 15, 2016

(30) Foreign Application Priority Data

Feb. 14, 2014 (JP) ..... 2014-026824

(51) Int. Cl.
*H01H 13/02* (2006.01)
*H01H 13/14* (2006.01)
(Continued)

(52) U.S. Cl.
CPC ..... *H01H 13/14* (2013.01); *B25F 5/00* (2013.01); *H01H 13/08* (2013.01); *H01H 13/66* (2013.01);
(Continued)

(58) Field of Classification Search
CPC ..... H01R 13/436; H01H 13/14; H01H 13/08; H01H 19/635; H01H 19/6355; H01H 9/06
(Continued)

(56) References Cited

U.S. PATENT DOCUMENTS 6,717,080 B1 * 4/2004 Chan ..... H01H 13/08 200/200
2006/0186102 A1 8/2006 Inagaki et al.

FOREIGN PATENT DOCUMENTS

EP 2031614 A1 3/2009
JP H06-223674 A 8/1994
(Continued)

OTHER PUBLICATIONS

Extended European search report (EESR) dated Aug. 18, 2017 in a counterpart European patent application.

*Primary Examiner* — Vanessa Girardi
(74) *Attorney, Agent, or Firm* — Metrolexis Law Group, PLLC

(57) ABSTRACT

A pair of open/close and current-passing movable contact pieces is supported on a movable contact terminal such that the pair is rotatable along with the reciprocation of an operating element. An open/close movable contact is mounted on the open/close movable contact piece and is rotatably biased by a spring member. A current-passing movable contact is mounted on the current-passing movable contact piece. By moving the operating element, a restriction imposed on a position of the operating element is released so that the open/close movable contact piece is rotated by a spring force of the spring member whereby the open/close movable contact is brought into pressure contact with an open/close fixed contact mounted on a fixed contact terminal. The current-passing movable contact piece is rotated by the operating element so that the current-passing movable
(Continued)

contact is brought into pressure contact with a current-passing fixed contact mounted on the fixed contact terminal.

20 Claims, 9 Drawing Sheets

(51) Int. Cl.

| | |
|---|---|
| ***B25F 5/00*** | (2006.01) |
| ***H01H 13/66*** | (2006.01) |
| ***H01H 13/08*** | (2006.01) |
| *H01H 1/58* | (2006.01) |
| *H01H 9/06* | (2006.01) |

(52) U.S. Cl.
CPC ..... *H01H 1/5833* (2013.01); *H01H 9/061* (2013.01); *H01H 2235/01* (2013.01)

(58) Field of Classification Search
USPC ..... 200/341, 522
See application file for complete search history.

(56) References Cited

FOREIGN PATENT DOCUMENTS

| | | | |
|---|---|---|---|
| JP | 2010-186672 | A | 8/2010 |
| JP | 2010-192452 | A | 9/2010 |
| JP | 2012-094553 | A | 5/2012 |

* cited by examiner

| | BEFORE OPERATION | DURING OPERATION | AFTER OPERATION |
|---|---|---|---|
| BATTING-TYPE CONTACT | OFF | ON | ON |
| SEESAW TYPE CONTACT | OFF | OFF | ON |

CONTACT MECHANISM HAVING MOVABLE CONTACT PIECES, TRIGGER SWITCH AND ELECTRIC TOOL WITH SAME

TECHNICAL FIELD

The present invention relates to a contact mechanism, for example, a contact mechanism used in a trigger switch of an electric tool.

BACKGROUND ART

Conventionally, a trigger switch used in an electric tool is required to allow a large electric current to pass therethrough and to ensure a predetermined contact pressure at a contact so as to prevent chattering of the contact caused by vibration during an operation of the electric tool. For this end, there has been proposed a so-called seesaw type movable contact piece which directly rotates a switching bar (movable contact piece) 26 by a slide shaft 21 which reciprocates in an axial direction by an operation of an operation unit 11 (see patent literature 1). According to such a seesaw type movable contact piece, a sufficient contact pressure can be ensured at a contact 77 of the switching bar 26 due to the operation of the operation unit 11 and hence, chattering during the operation can be prevented whereby the seesaw type movable contact piece has high contact reliability.

CITATION LIST

Patent Literature

PTL 1: 2010-192452

SUMMARY OF INVENTION

Technical Problem

However, in the seesaw type movable contact piece, slippage is liable to occur in timing of contacting or separation of contacts and hence, irregularities are liable to occur in an open/close characteristic.

Particularly, at the time of contacting of a movable contact, a contact pressure is extremely low and hence, chattering is liable to occur at the movable contact, and an arc is liable to be generated. Accordingly, a surface of the contact is worn by the arc thus giving rise to a drawback that contact reliability is lowered.

The present invention has been made in view of the above-mentioned drawbacks, and it is an object of the present invention to provide a contact mechanism where vibration resistance can be increased and, particularly, chattering during an operation can be prevented so that contact reliability is high and, at the same time, there is no irregularity in an open/close characteristic.

Solution to Problem

To overcome the above-mentioned drawbacks, a contact mechanism according to the present invention is configured such that a pair of movable contact pieces is mounted on a movable contact terminal in a juxtaposed manner such that the pair of movable contact pieces is rotatable along with reciprocation of an operating element, an open/close movable contact is mounted on an open/close movable contact piece which forms a first one of the movable contact pieces, the open/close movable contact piece is biased in a contact closing direction by a spring member, and a current-passing movable contact is mounted on a current-passing movable contact piece which forms a second one of the movable contact pieces, wherein the contact mechanism is configured such that, with manipulation of the operating element, the open/close movable contact piece is rotated by a spring force of the spring member, the open/close movable contact is brought into pressure contact with an open/close fixed contact mounted on a fixed contact terminal, and the operating element rotates the current-passing movable contact piece so as to bring the current-passing movable contact into pressure contact with a current-passing fixed contact mounted on the fixed contact terminal.

Advantageous Effects of Invention

According to the present invention, the open/close movable contact piece is rotated quickly by the spring force of the spring member, and the open/close movable contact is brought into pressure contact with the open/close fixed contact and hence, no slippage occurs in timing of contacting of the contacts whereby a contact mechanism which has no irregularities in an open/close characteristic can be acquired.

Further, the operating element rotates the current-passing movable contact piece and hence, a desired contact pressure can be ensured whereby vibration resistance can be increased and, particularly, chattering during an operation can be prevented. Accordingly, a contact mechanism having high contact reliability can be acquired.

According to a mode of the present invention, the current-passing movable contact may be brought into pressure contact with the current-passing fixed contact after the open/close movable contact is brought into pressure contact with the open/close fixed contact along with the operation of the operating element.

According to this mode, initially, the open/close movable contact is quickly brought into contact with the open/close fixed contact by the spring force of the spring member and, at the same time, a fixed contact pressure can be ensured. Accordingly, chattering less likely to occur and an arc is less likely to be generated thus prolonging a lifetime of the contacts.

The current-passing movable contact is brought into contact with the current-passing fixed contact after the open/close movable contact is quickly brought into contact with the open/close fixed contact and hence, an arc is not generated between the current-passing movable contact and the current-passing fixed contact. Accordingly, not only the current-passing movable contact and the current-passing fixed contact can be manufactured using an inexpensive contact material but also the current-passing movable contact and the current-passing fixed contact can be formed also by protrusion processing.

According to another mode of the present invention, the open/close movable contact may be separated from the open/close fixed contact after the current-passing movable contact is separated from the current-passing fixed contact along with a restoring operation of the operating element.

According to this mode, an arc is not generated at the time of separating the current-passing movable contact from the current-passing fixed contact and hence, the contacts are less likely to be worn whereby the lifetime of the contacts can be prolonged.

According to another mode of the present invention, a lower end portion of a coil spring which forms the spring member may be brought into contact with an inner surface of a housing in which the pair of movable contact pieces is housed.

According to this mode, a spring member which biases the open/close movable contact piece is positioned on an inner surface of the housing which forms a fixed part. Accordingly, no irregularities occur in assembling accuracy, and no irregularities occur in operational characteristics of the open/close movable contact piece and hence, a contact mechanism which has no irregularities in an open/close characteristic can be acquired.

A trigger switch according to the present invention may be configured such that the trigger switch includes the above-mentioned contact mechanism.

According to the present invention, a trigger switch which has no irregularities in an open/close characteristic and exhibits high contact reliability can be acquired.

An electric tool according to the present invention may be configured such that the electric tool includes the above-mentioned trigger switch.

According to the present invention, the open/close movable contact piece is rotated quickly by the spring force of the spring member, and the open/close movable contact is brought into pressure contact with the open/close fixed contact and hence, no slippage occurs in timing of contacting of the contacts whereby an electric tool which has no irregularities in an open/close characteristic can be acquired.

Further, the operating element rotates the current-passing movable contact piece and hence, a desired contact pressure can be ensured whereby vibration resistance can be increased and, particularly, chattering during an operation can be prevented. Accordingly, the present invention has an advantageous effect that an electric tool having high contact reliability can be acquired.

DESCRIPTION OF EMBODIMENTS

Attached drawings from FIG. 1A to FIG. 9B show the case where a contact mechanism according to an embodiment of the present invention is applied to a trigger switch of an electric tool.

Figure 1A:
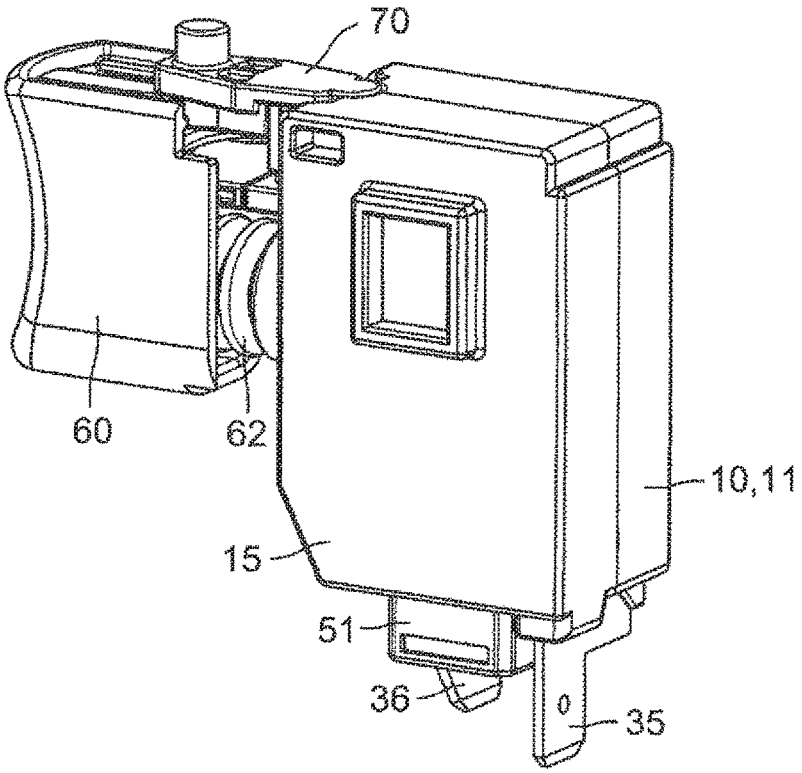
FIG. 1A and FIG. 1F are overall perspective views of a trigger switch according to the present invention as viewed from different angles respectively.
Figure 1B:
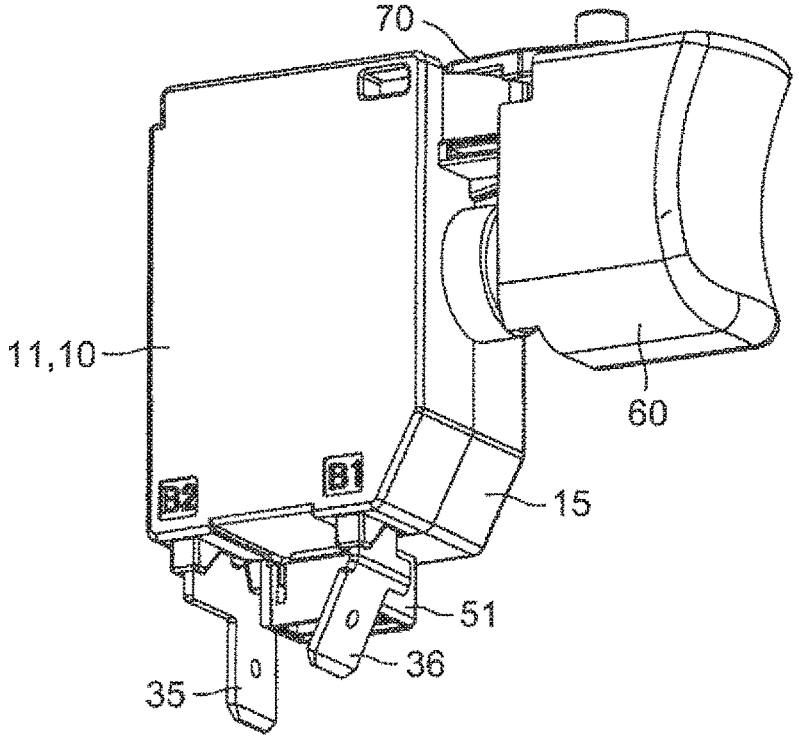
Figure 2:
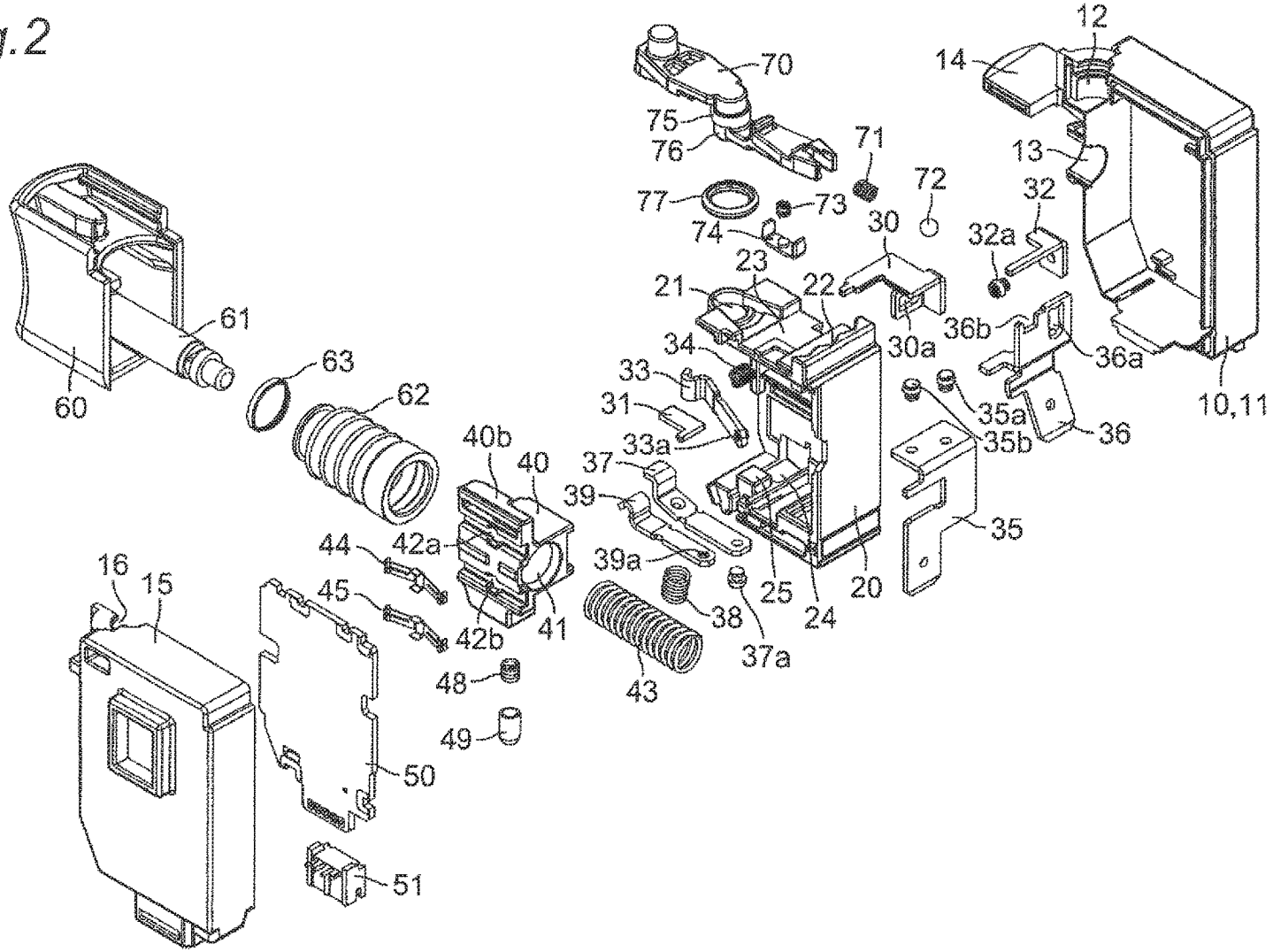
FIG. 2 is an exploded perspective view of the trigger switch shown in FIG. 1A.
Figure 3:
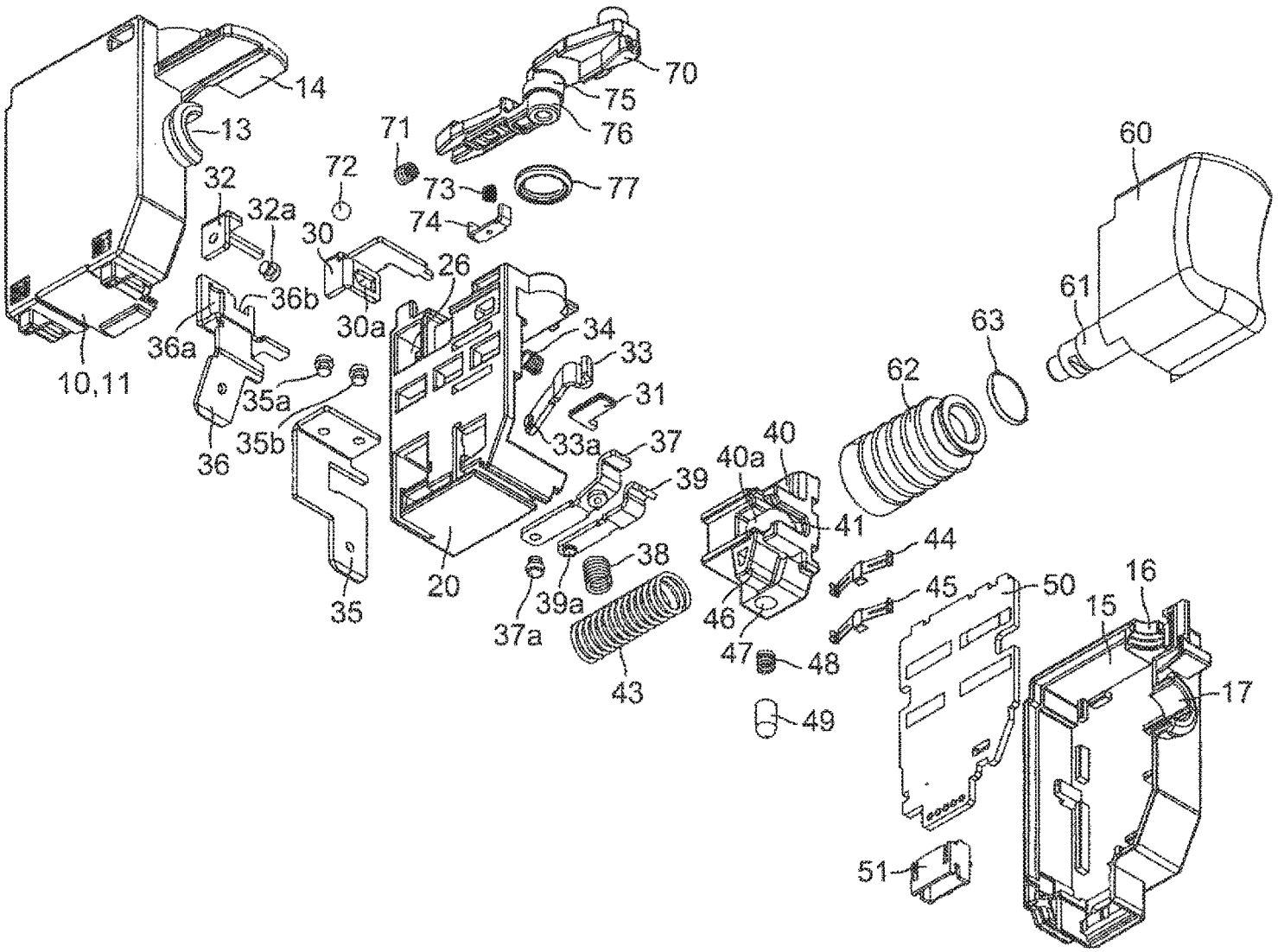
FIG. 3 is an exploded perspective view of the trigger switch shown in FIG. 1B.

That is, as shown in FIG. 2 and FIG. 3, the trigger switch is configured such that internal constitutional parts such as a base 20, a plunger 40, and a printed circuit board 50 are incorporated into a housing 10 which is formed by combining a first cover 11 and a second cover 15, and a trigger 60 and a switch lever 70 are mounted on the housing 10.

As shown in FIG. 2, a semi-circular fitting recess 12 for supporting the switch lever 70 described later is formed on a portion of an upper surface of the first cover 11 on a lateral side of the first cover 11. A semi-circular rib 13 for supporting an operating rod 61 of the trigger 60 is formed on an outer surface of the first cover 11 at a position directly below the fitting recess 12. A guide member 14 is formed on the first cover 11 in a projecting manner on one side of the first cover 11 such that the guide member 14 is disposed adjacently to the fitting recess 12.

As shown in FIG. 3, the second cover 15 has a front shape which allows the second cover 15 to contact with the first cover 11. A semi-circular fitting recess 16 for supporting the switch lever 70 described later is formed on a portion on one side of an upper surface of the second cover 15. A semi-circular rib 17 for supporting the operating rod 61 of the trigger 60 is formed on an outer surface of the second cover 15 at a position directly below the fitting recess 16.

A joining surface of the second cover 15 is integrally joined to the first cover 11 by ultrasonic welding or by an adhesive agent except for portions of the joining surface on which the operating rod 61 of the trigger 60 and the switch lever 70 are mounted.

As shown in FIG. 2, the base 20 has a shape which is obtained by cutting away one side surface from a box shape. A positioning recessed portion 21 for positioning the switch lever 70 is formed on a portion on one side of an upper portion of the base 20. A serrated uneven portion 22 for generating click feeling is formed on a portion on the other side of the upper portion of the base 20. A recessed portion 23 for disposing a relay terminal described later therein is formed between the positioning recessed portion 21 and the uneven portion 22 for generating click feeling. A positioning recessed portion 24 for positioning a movable contact spring 38 described later and a pedestal portion 25 for restricting the position of a current-passing movable contact piece 39 are formed in a juxtaposed manner on a bottom surface of the base 20 which forms a lower surface of the base 20.

As shown in FIG. 2, on the base 20, a bent common relay terminal 30 and a bent first relay terminal 31 are disposed in the recessed portion 23 for disposing a relay terminal such that the common relay terminal 30 and the first relay terminal 31 become coplanar with each other. The common relay terminal 30 rotatably supports a relay movable contact piece 33 inserted into a support hole 30*a* formed in the common relay terminal 30 by way of a relay movable contact spring 34. As shown in FIG. 3, in the base 20, a second relay terminal 32 which has a relay fixing contact 32*a* is mounted in a fitting hole 26 formed in the base 20. With such a configuration a relay movable contact 33*a* mounted on one end portion of the relay movable contact piece 33 faces the relay fixing contact 32*a* fixed to the second relay terminal 32 by swaging such that the relay movable contact 33*a* can be brought into contact with or separated from the relay fixing contact 32*a* (FIG. 6B).

Figure 4:
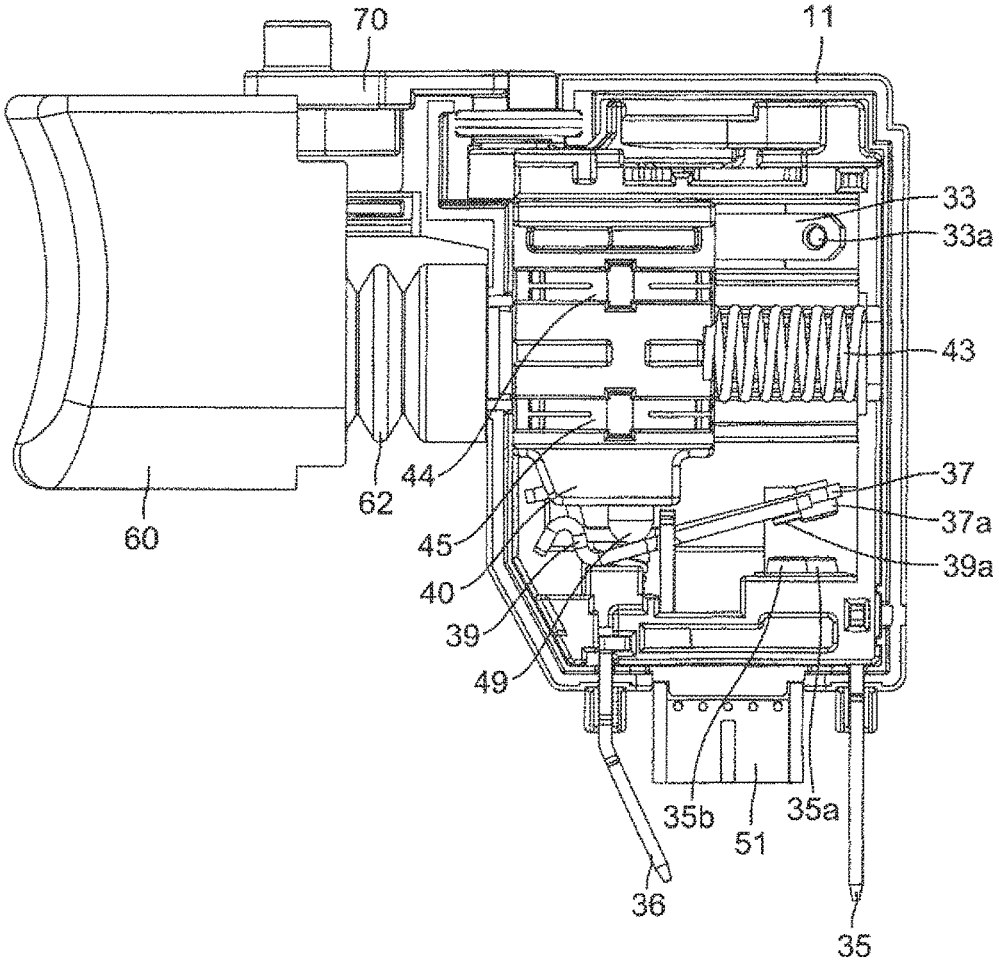
FIG. 4 is a partial cross-sectional front view of the trigger switch before the trigger switch is operated.

As shown in FIG. 2, the base 20 is configured such that a fixed contact terminal 35 and a movable contact terminal 36 are press-fitted into and fixed to a lower side of the base 20 from sideward. An open/close fixed contact 35*a* and a current-passing fixed contact 35*b* which form a pair are fixed to the fixed contact terminal 35 by swaging. On the other hand, a support hole 36*a* and a notched portion 36*b* are formed on an upper end portion of the movable contact terminal 36 in a juxtaposed manner. An open/close movable contact piece 37 is inserted into the support hole 36*a*, and the open/close movable contact piece 37 is rotatably supported by the support hole 36*a* by way of a movable contact spring 38. A current-passing movable contact piece 39 is rotatably supported by the notched portion 36*b* (FIG. 4). With such a configuration, an open/close movable contact 37*a* and a current-passing movable contact 39*a* mounted on the open/close movable contact piece 37 and the current-passing movable contact piece 39 respectively face the open/close fixed contact 35*a* and the current-passing fixed contact 35*b* mounted on the fixed contact terminal 35 such that the open/close movable contact 37*a* and the current-passing movable contact 39*a* can be brought into contact with or separated from the open/close fixed contact 35*a* and the current-passing fixed contact 35*b*.

As shown in FIG. 2, the plunger 40 has an outer shape which allows the plunger 40 to be slidably movable in the base 20. A through hole 41 is formed in the plunger 40 such that the through hole 41 penetrates the plunger 40 sideward. A pair of guide grooves 42*a*, 42*b* is formed on one outer surface of the plunger 40 in a juxtaposed manner. The plunger 40 has the structure where a restoring spring 43 is insertable into the through hole 41, and sliders 44, 45 can be press-fitted into and fixed to the pair of guide grooves 42*a*, 42*b* respectively. With such a configuration, the plunger 40 can be housed in the base 20 such that the plunger 40 is reciprocable in the axial direction by way of the restoring spring 43.

As shown in FIG. 3, an operating portion 46 having a tapered surface is formed on a bottom surface of the plunger 40 in a projecting manner, and an insertion hole 47 is formed in the plunger 40 at a position disposed adjacently to the operating portion 46. The plunger 40 has the structure where a coil spring 48 and an operating piece 49 are inserted into the insertion hole 47 so that the operating piece 49 is biased by the coil spring 48.

As shown in FIG. 2, the printed circuit board 50 has a front shape which allows the printed circuit board 50 to cover an opening portion of the base 20. Slide resistors not shown in the drawing are printed on a surface of the printed circuit board 50 which faces inward. A microcomputer is mounted on the printed circuit board 50. A socket 51 is mounted on a lower end portion of the printed circuit board 50. The printed circuit board 50 can be integrally mounted on the base 20 which houses the plunger 40 therein by assembling the printed circuit board 50 on the base 20 by fitting and by electrically connecting the common relay terminal 30, the first relay terminal 31 and the like to the printed circuit board 50. By slidably moving the plunger 40, the pair of sliders 44, 45 mounted on the plunger 40 slides along the slide resistors printed on the printed circuit board 50 so that a resistance value is changed.

Figure 5:
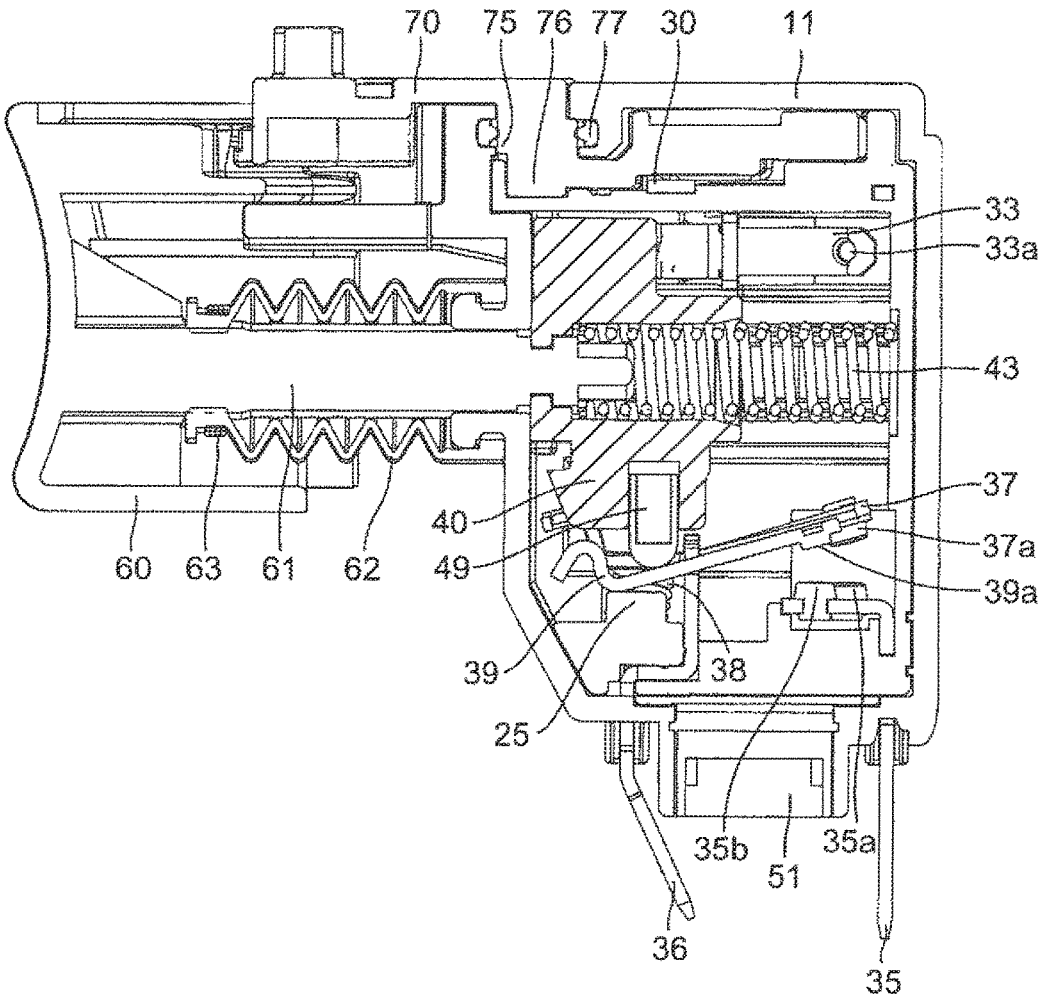
FIG. 5 is a cross-sectional front view of the trigger switch before the trigger switch is operated.

As shown in FIG. 2, the trigger 60 includes the operating rod 61 which projects sideward. As shown in FIG. 5, one end portion of a bellow-shaped cylindrical body 62 into which the operating rod 61 is inserted is fixed by a coil ring 63 to prevent the removal of the bellow-shaped cylindrical body 62. The trigger 60 can be integrally mounted on the plunger 40 by making a distal end portion of the operating rod 61 projecting from the bellow-shaped cylindrical body 62 engage with an engaging hole 40*a* formed in the plunger 40 (FIG. 3) by slidable engagement.

The other end portion of the bellow-shaped cylindrical body 62 into which the operating rod 61 is inserted is made to engage with semi-circular ribs 13, 17 of the first and second covers 11, 15 so that the bellow-shaped cylindrical body 62 has the waterproof structure.

As shown in FIG. 2, a steel ball 72 is incorporated into one end portion of the switch lever 70 by way of a coil spring 71 such that the steel ball 72 is biased toward the outside, while as shown in FIG. 3, a rotatable contact piece 74 having a U-shape in cross section is mounted on a surface of the switch lever 70 on one end side by way of a coil spring 73. A rotary shaft portion 76 is formed in a projecting manner coaxially with a flange portion 75 which is positioned at an intermediate portion of the switch lever 70 and also directly below the flange portion 75. The rotary shaft portion 76 is positioned in the positioning recessed portion 21 of the base 20, and the flange portion 75 can be rotatably supported by the semi-circular fitting recesses 12, 16 of the first and second covers 11, 15 by way of a seal ring 77. With such a configuration, when the switch lever 70 is rotated using the rotary shaft portion 76 as a fulcrum, the rotatable contact piece 74 is rotated, and both end portions of the rotatable contact piece 74 are brought into contact with only the common relay terminal 30 or is brought into contact with the common relay terminal 30 and the first relay terminal 31. As a result, an electric circuit of the printed circuit board 50 is switched so that the rotational direction of a motor not shown in the drawing can be reversed.

The steel ball 72 biased by the coil spring 71 engages with the uneven portion 22 for generating click feeling which is formed on the base 20 and hence, click feeling can be acquired by manipulating the switch lever 70.

To describe a method of assembling the trigger switch, firstly, the second relay terminal 32 to which the common relay terminal 30, the first relay terminal 31, and the relay fixing contact 32*a* are fixed by swaging is mounted on the base 20. Next, the relay movable contact piece 33 on which the relay movable contact 33*a* is disposed is rotatably supported by the support hole 30*a* formed in the common relay terminal 30 by way of the relay movable contact spring 34. With such an operation, the relay movable contact 33*a* faces the relay fixing contact 32*a* such that the relay movable contact 33*a* can be brought into contact with or separated from the relay fixing contact 32*a*.

Then, the fixed contact terminal 35 and the movable contact terminal 36 having the open/close fixed contact 35*a* and the current-passing fixed contact 35*b* respectively are mounted on the base 20. Then, an open/close movable contact piece 37 to which the open/close movable contact 37*a* is fixed by swaging is inserted into the support hole 36*a* formed in the movable contact terminal 36. The open/close movable contact piece 37 is rotatably supported by the support hole 36*a* formed in the movable contact terminal 36 by way of the movable contact spring 38 having the lower end portion thereof positioned in the positioning recessed portion 24 of the base 20. Next, the current-passing movable contact piece 39 having the current-passing movable contact 39*a* is rotatably supported by the notched portion 36*b* formed in the movable contact terminal 36. With such an operation, the open/close movable contact 37*a* and the current-passing movable contact 39*a* face the open/close fixed contact 35*a* and the current-passing fixed contact 35*b* respectively such that the open/close movable contact 37*a* and the current-passing movable contact 39*a* can be brought into contact with or separated from the open/close fixed contact 35*a* and the current-passing fixed contact 35*b*.

Next, sliders 44, 45 are press-fitted into and fixed to the pair of guide grooves 42*a*, 42*b* formed in the plunger 40 respectively and, at the same time, the coil spring 48 and the operating piece 49 are inserted into the insertion hole 47 formed in the plunger 40 (FIG. 3), and is held by a jig not shown in the drawing. On the other hand, the operating rod 61 of the trigger 60 is inserted into the bellow-shaped cylindrical body 62, and the operating rod 61 is fixed on the bellow-shaped cylindrical body 62 by the coil ring 63 so as to prevent the removal of the bellow-shaped cylindrical body 62 and, the distal end portion of the operating rod 61 projecting from the bellow-shaped cylindrical body 62 is fitted in the engaging hole 40*a* formed in the plunger 40 by slide engagement from a side so that the plunger 40 and the operating rod 61 are integrally joined with each other. Then, in a state where the restoring spring 43 is inserted into the through hole 41, the plunger 40 is housed in the base 20 such that the plunger 40 can be slidably moved. Then, the printed circuit board 50 on which the socket 51 is mounted is mounted on the opening portion of the base 20 by fitting and, thereafter, the common relay terminal 30, the first relay terminal 31, the second relay terminal 32, the fixed contact terminal 35 and, the movable contact terminal 36 are electrically connected to the printed circuit board 50.

On the other hand, the switch lever 70 is formed such that while the seal ring 77 is mounted on the flange portion 75 of the switch lever 70, the coil spring 71 and the steel ball 72 are incorporated into one end portion of the switch lever 70 by way of a jig not shown in the drawing and, the coil spring 73 and the rotatable contact piece 74 are mounted on the lower surface of the switch lever 70 on one end side. Then, the rotary shaft portion 76 of the switch lever 70 is positioned in the positioning recessed portion 21 of the base 20 in a rotatable manner. Then, the first and second covers 11, 15 are mounted on the base 20 from both sides so that the removal of the switch lever 70 is prevented. Next, the opening edge portion of the seal ring 77 is fitted in the semi-circular ribs 13, 17 of the first and second covers 11, 15. Lastly, the first and second covers 11, 15 are joined to each other by ultrasonic welding or by an adhesive agent so that the first and second covers 11, 15 are integrally formed with each other. By performing the above-mentioned operations, an assembling operation of the trigger switch is completed.

Next, a method of manipulating the trigger switch is described.

Figure 6A:
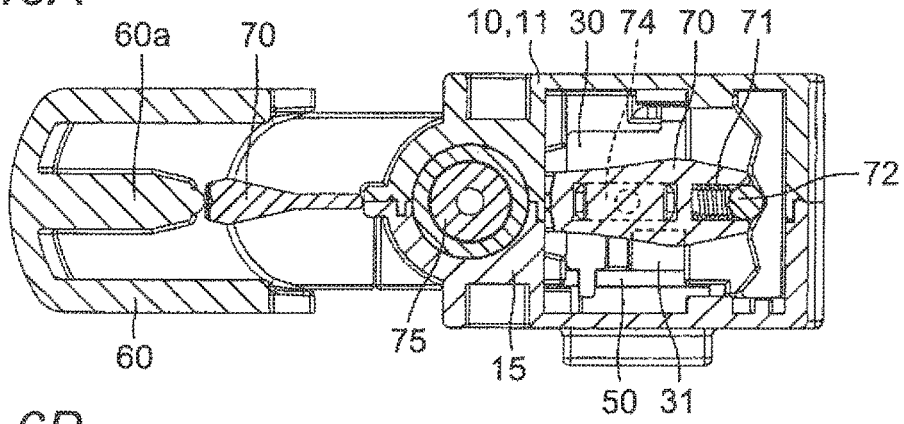
FIG. 6A, FIG. 6B, FIG. 6C, and FIG. 6D are planar cross-sectional views of the trigger switch at different positions before the trigger switch is operated.
Figure 6B:
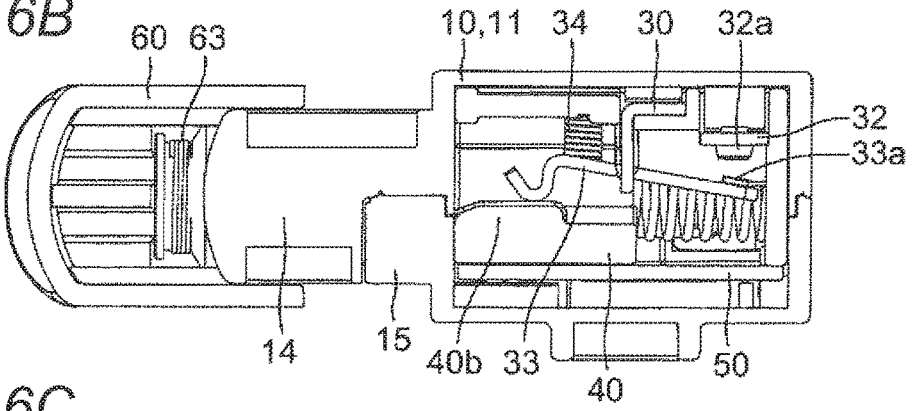
Figure 6C:
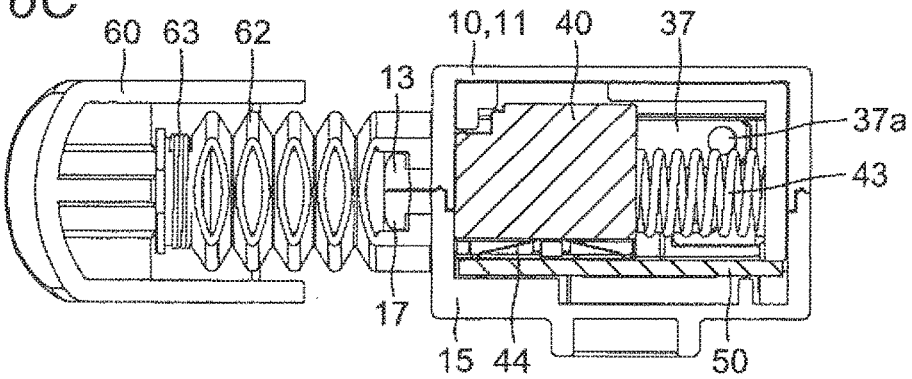
Figure 6D:
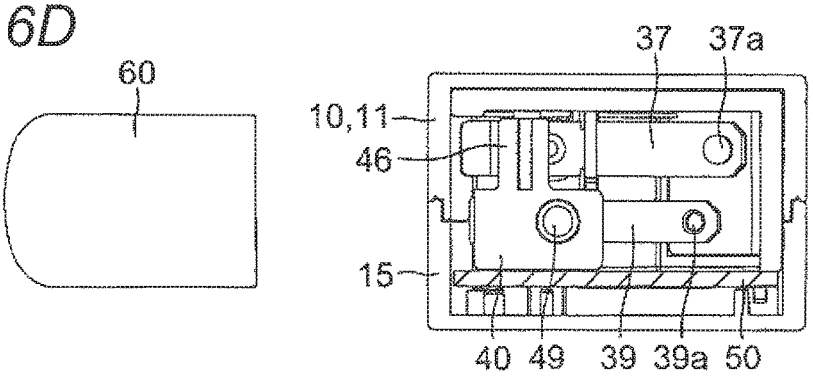
Figure 7:
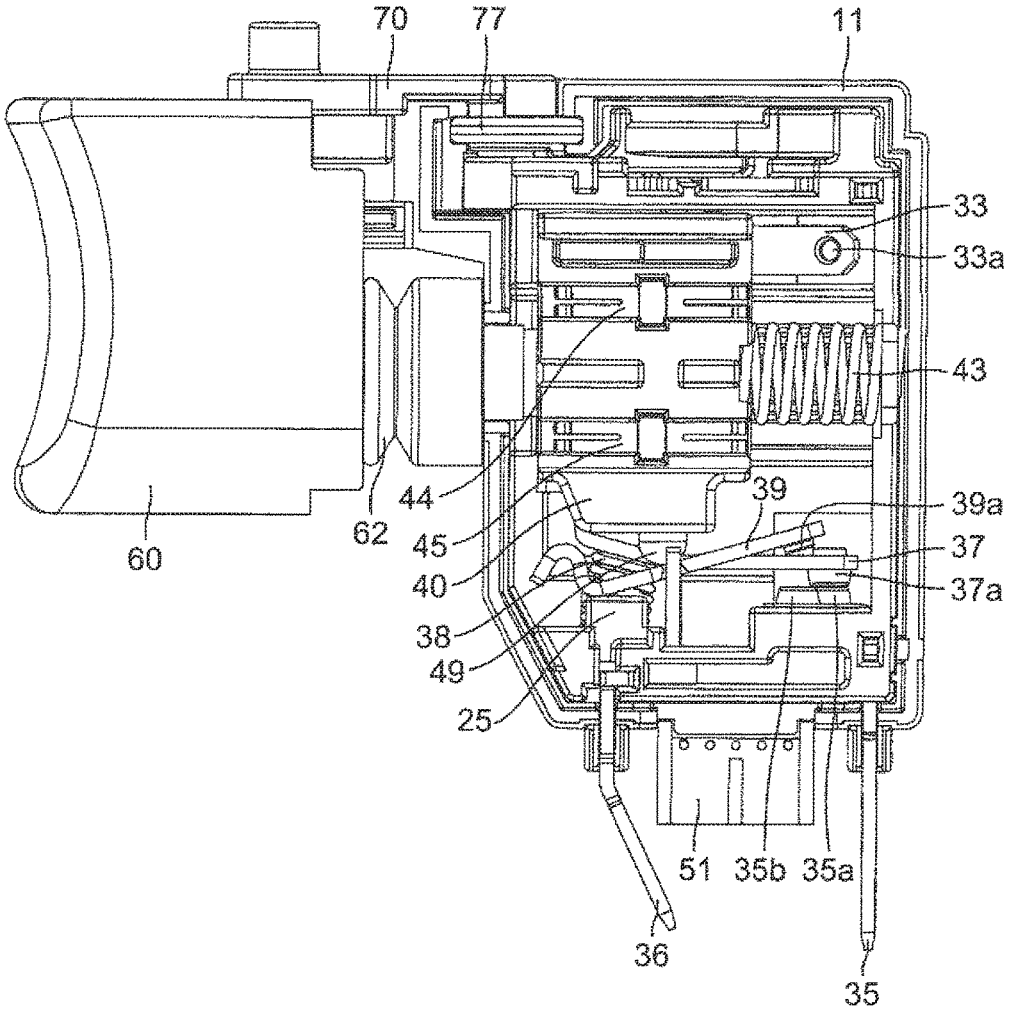
FIG. 7 is a cross-sectional front view of the trigger switch during the operation of the trigger switch.
Figure 8:
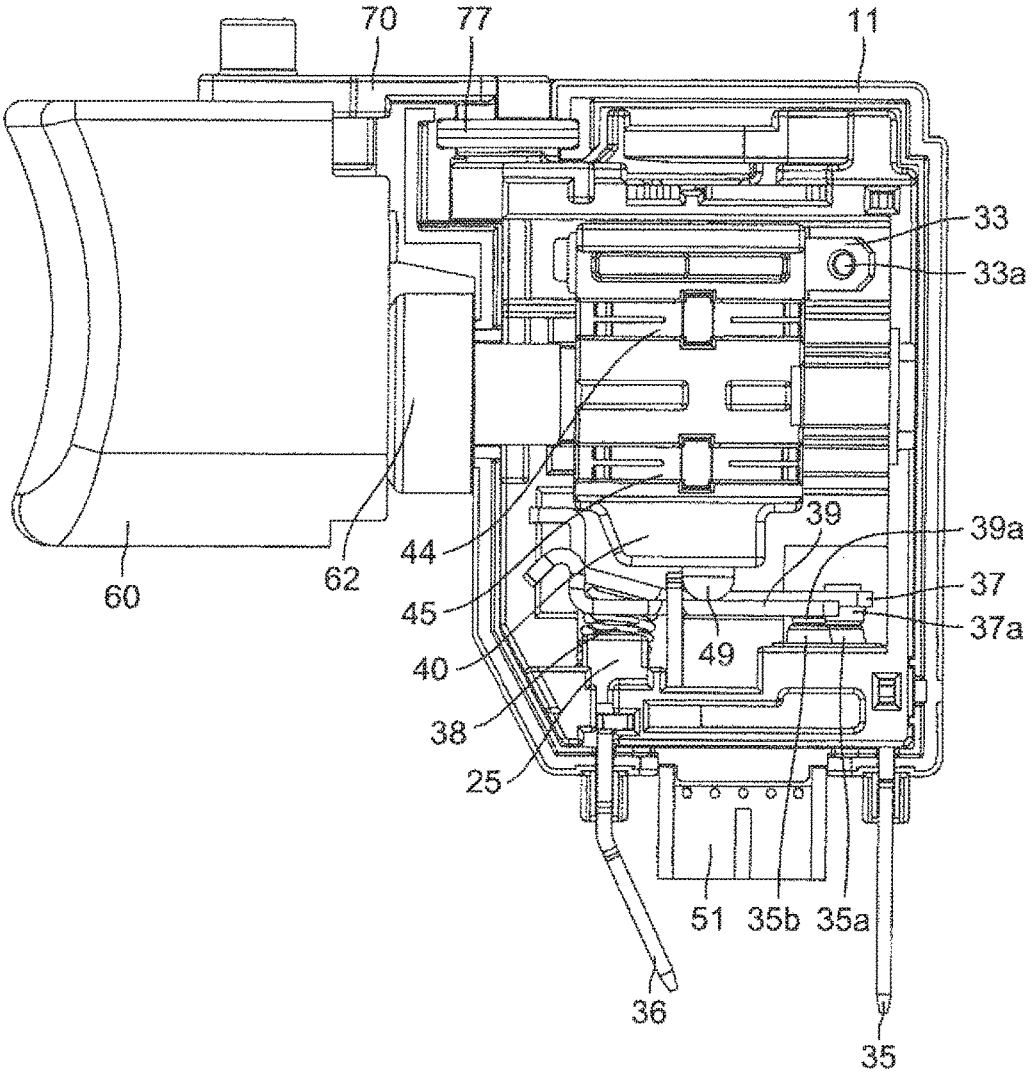
FIG. 8 is a cross-sectional front view of the trigger switch after the trigger switch is operated.
Figure 9A:
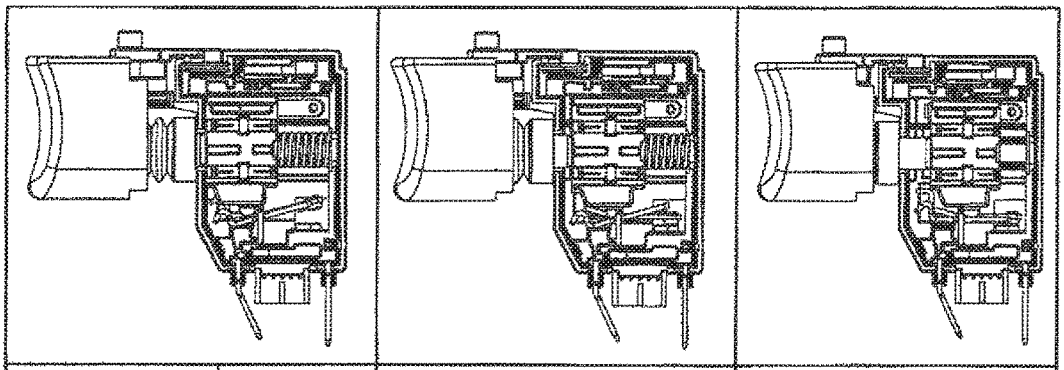
FIG. 9A is a view showing an ON/OFF state of a contact before, during, and after the operation.
Figure 9B:
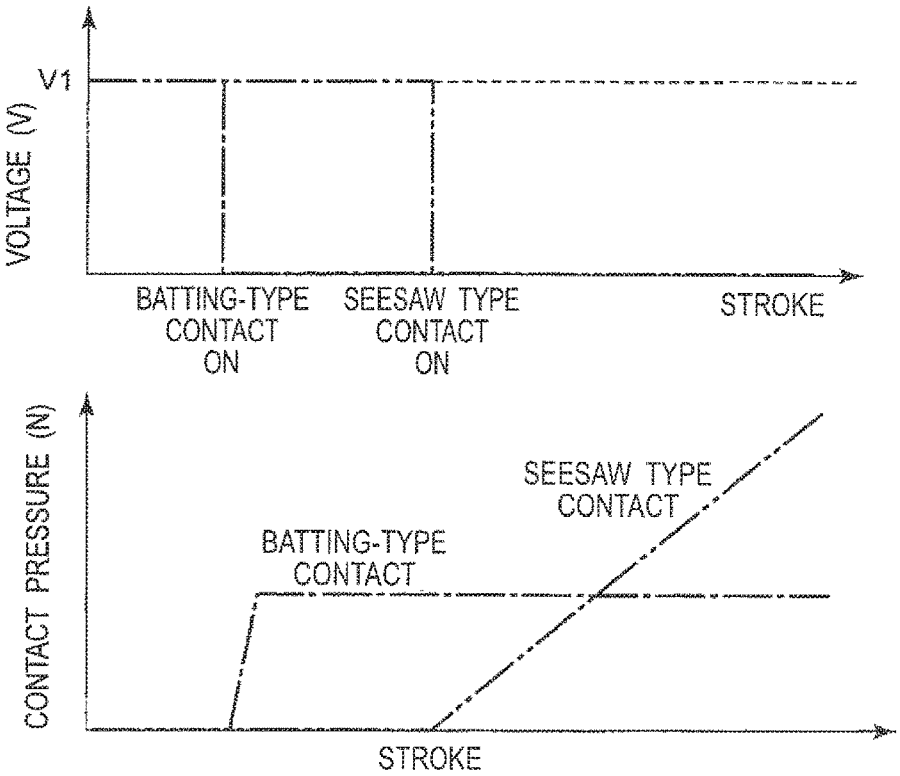
FIG. 9B is a graph showing the relationship between a stroke and a voltage and the relationship between a stroke and a contact pressure.

When the switch lever 70 is at a neutral position as shown in FIG. 6A, one end portion of the switch lever 70 is brought into contact with the center projection 60*a* of the trigger 60 so that the trigger 60 cannot be depressed whereby an erroneous manipulation can be prevented.

When the switch lever 70 is rotated in a counterclockwise direction from a state shown in FIG. 6A using the flange portion 75 as a fulcrum, both ends of the rotatable contact piece 74 are brought into contact with only the common relay terminal 30. At a point of time immediately before the trigger 60 is depressed, the sliders 44, 45 are brought into contact with the slide resistors (not shown in the drawing) on the printed circuit board 50 with maximum resistance values. As shown in FIG. 6B, although the relay movable contact piece 33 is biased by a spring force of the relay movable contact spring 34, the position of the relay movable contact piece 33 is restricted at the stepped portion 40*b* of a plunger 40 and hence, the relay movable contact 33*a* is separated from the relay fixing contact 32*a*.

On the other hand, although the open/close movable contact piece 37 is biased by the movable contact spring 38 (FIG. 5), the position of the open/close movable contact piece 37 is restricted to the operating portion 46 of the plunger 40 which is biased by the restoring spring 43, and the open/close movable contact 37*a* faces the open/close fixed contact 35*a* such that the open/close movable contact 37*a* can be brought into contact with or separated from the open/close fixed contact 35*a*. The position of the current-passing movable contact piece 39 rotatably supported which is supported in a rotatable manner is restricted by being pressed by the operating piece 49 mounted on the plunger 40. Accordingly, the end portion of the current-passing movable contact piece 39 is brought into pressure contact with the pedestal portion 25 of the base (FIGS. 4, 5) and, at the same time, the current-passing movable contact 39*a* faces the current-passing fixed contact 35*b* such that the current-passing movable contact 39*a* can be brought into contact with or separated from the current-passing fixed contact 35*b*.

For the sake of convenience of the description, the coil spring 48 is not shown in FIG. 5.

Firstly, when an operator depresses the trigger 60, the plunger 40 which engages with the operating rod 61 of the trigger 60 moves in a sliding manner. Accordingly, the sliders 44, 45 mounted on the plunger 40 slide on the printed circuit board 50. As the sliders 44, 45 slide, resistance values are decreased so that an amount of electric current which flows through the printed circuit board 50 is increased whereby an operation lamp or the like not shown in the drawing is turned on.

When the trigger 60 is further depressed, the restriction imposed on the position of the relay movable contact piece 33 by the stepped portion 40*b* of the plunger 40 is released so that the relay movable contact piece 33 is rotated by the spring force of the relay movable contact spring 34. Accordingly, the relay movable contact 33*a* is brought into contact with the relay fixing contact 32*a*, and a rated electric current flows through the printed circuit board 50. Substantially at the same time, the restriction imposed on the position of the open/close movable contact piece 37 by the operating portion 46 of the plunger 40 is released. Accordingly, the open/close movable contact piece 37 is rotated by a spring force of the movable contact spring 38, and the open/close movable contact 37*a* is brought into contact with the open/close fixed contact 35*a* (see FIG. 7 and FIG. 9).

When the trigger 60 is further depressed, the operating rod 61 is pushed to a depth side of the base 20 so that the operating piece 19 mounted on the plunger 40 rotates the current-passing movable contact piece 39. Accordingly, the current-passing movable contact 39*a* is brought into contact with the current-passing fixed contact 35*b* (FIG. 8) and, at the same time, a sliding resistance value becomes substantially zero. As a result, maximum electric currents flow through the sliders 44, 45, and a signal is outputted from the microcomputer not shown in the drawing so as to set a rotational speed of the motor to a maximum value. For the sake of convenience of the description, a restoring spring 43 is not shown in FIG. 8.

According to this embodiment, a so-called batting-type movable contact piece is adopted where the open/close movable contact piece 37 is biased by the spring force of the movable contact spring 38 thus ensuring a contact pressure. Accordingly, it is possible to acquire advantageous effects that no slippage occurs in timing of contacting of the contacts, and there is no irregularity in an open/close characteristic.

Further, when an operator decreases a force of depressing the trigger 60, the plunger 40 is pushed back by a spring force of the restoring spring 43, and the sliders 44, 45 slide on the printed circuit board 50 in the reverse direction. The operating piece 49 of the plunger 40 rotates the current-passing movable contact piece 39 in the direction opposite to the above-mentioned direction and hence, the current-passing movable contact 39*a* is separated from the current-passing fixed contact 35*b* and, thereafter, one end portion of the current-passing movable contact piece 39 is brought into pressure contact with the pedestal portion 25 of the base 20. Thereafter, the open/close movable contact piece 37 is rotated by the operating portion 46 of the plunger 40 against the spring force of the movable contact spring 38, and the open/close movable contact 37*a* is separated from the open/close fixed contact 35*a*. Then, the relay movable contact piece 33 is rotated by the stepped portion of the plunger 40 against the spring force of the relay movable contact spring 34, and the relay movable contact 33*a* is separated from the relay fixing contact 32*a* and, thereafter, the sliders 44, 45 return to original positions.

When the switch lever 70 is rotated in a clockwise direction from a neutral position about the flange portion 75, the steel ball 72 overrides the uneven portion 22 for generating click feeling, and both end portions of the rotatable contact piece 74 are brought into contact with the common relay terminal 30 and the first relay terminal 31. Accordingly, when the trigger 60 is depressed in the same manner as described above, the motor is rotated in the reverse direction.

INDUSTRIAL APPLICABILITY

It is needless to say that the contact mechanism according to the present invention is not limited to the above-mentioned trigger switch and is also applicable to other switches.

REFERENCE SIGNS LIST

10. housing
11. first cover
15. second cover
20. base
22. uneven portion for generating click feeling
24. positioning recessed portion
25. pedestal portion
30. common relay terminal
30*a*. support hole
31. first relay terminal
32. second relay terminal
32*a*. relay fixing contact
33. relay movable contact piece
33*a*. relay movable contact
34. relay movable contact spring
35. fixed contact terminal
35*a*. open/close fixed contact
35*b*. current-passing fixed contact
36. movable contact terminal
36*a*. support hole
36*b*. notched portion
37. open/close movable contact piece
37*a*. open/close movable contact
38. movable contact spring
39. current-passing movable contact piece
39*a*. current-passing movable contact
40. plunger (operating element)
40*a*. engaging hole
40*b*. stepped portion
41. through hole
43. restoring spring
44. slider
45. slider
46. operation unit
48. coil spring
49. operating piece
50. printed circuit board
51. socket
60. trigger
61. operating rod
70. switch lever
75. flange portion
76. rotatable shaft portion
77. seal ring

The invention claimed is:

1. A contact mechanism comprising:

an operating element reciprocally moving with respect to a housing;

a movable contact terminal housed in the housing;

a pair of movable contact pieces housed in the housing and mounted on the movable contact terminal in a juxtaposed manner such that the pair of movable contact pieces is rotatable about a rotational axis along with reciprocation movement of the operating element and each movable contact piece of the pair of movable contact pieces has a different length from each other in a radial direction with respect to the rotational axis;

an open/close movable contact mounted on an open/close movable contact piece forming a first movable contact piece of the movable contact pieces;

a current-passing movable contact mounted on a current-passing movable contact piece forming a second movable contact piece of the movable contact pieces;

a fixed contact terminal housed in the housing and facing the movable contact terminal;

an open/close fixed contact mounted on the fixed contact terminal so that the open/close movable contact is brought into contact with or separated from the open/close fixed contact;

a current-passing fixed contact mounted on the fixed contact terminal so that the current-passing movable contact is brought into contact with or separated from the current-passing fixed contact; and a spring member which is arranged to bias the open/close movable contact piece in a contact closing direction, wherein the contact mechanism is configured such that, with the reciprocation movement of the operating element, the open/close movable contact piece is rotated by bias of the spring member so as to bring the open/close movable contact into pressure contact with the open/close fixed contact, and the current-passing movable contact piece is rotated by the operating element so as to bring the current-passing movable contact into pressure contact with the current-passing fixed contact.

2. The contact mechanism according to claim 1, wherein the contact mechanism further comprises a pedestal portion restricting a position of the current-passing movable contact piece, the pedestal portion being provided within the housing such that the rotational axis of the pair of movable contact pieces is positioned between the open/close fixed contact and the current-passing fixed contact, and the pedestal portion in a moving direction of the operating element.

3. A trigger switch comprising the contact mechanism according to claim 1.

4. An electric tool comprising the trigger switch according to claim 3.

5. The contact mechanism according to claim 1, wherein a lower end portion of a coil spring forming the spring member is brought into contact with an inner surface of the housing.

6. A trigger switch comprising the contact mechanism according to claim 5.

7. An electric tool comprising the trigger switch according to claim 6.

8. The contact mechanism according to claim 1, wherein the operating element comprises:

an operating portion which restricts the open/close movable contact piece to a position where the open/close movable contact is separated from the open/close fixed contact against bias of the spring member in the contact closing direction in a manner such that position restriction is releasable by one-direction movement of the reciprocation movement of the operating element; and an operating piece which restricts rotation of the current-passing movable contact piece in a manner such that rotation restriction is releasable by further one-direction movement of the reciprocation movement of the operating element, and wherein after the operating piece makes the current-passing movable contact piece rotate in a direction opposite to in a contact closing direction along with a restoring operation opposite to the one-direction movement of the operating element, the current-passing movable contact is separated from the current-passing fixed contact, and thereafter, along with a further restoring operation of the operating element, the open/close movable contact piece is rotated against the bias of the spring member by the operating portion of the operating element, and then, the open/close movable contact is separated from the open/close fixed contact.

9. The contact mechanism according to claim 8, wherein a lower end portion of a coil spring forming the spring member is brought into contact with an inner surface of a housing in which the pair of movable contact pieces is housed.

10. A trigger switch comprising the contact mechanism according to claim 9.

11. A trigger switch comprising the contact mechanism according to claim 8.

12. An electric tool comprising the trigger switch according to claim 11.

13. The contact mechanism according to claim 1, wherein the operating element comprises:

an operating portion which restricts the open/close movable contact piece to a position where the open/close movable contact is separated from the open/close fixed contact against bias of the spring member in the contact closing direction in a manner such that position restriction is releasable by one-direction movement of the reciprocation movement of the operating element; and an operating piece which restricts rotation of the current-passing movable contact piece in a manner such that rotation restriction is releasable by further one-direction movement of the reciprocation movement of the operating element, and wherein after the position restriction of the open/close movable contact piece by the operating portion is released along with the one-direction movement of the operating element, the open/close movable contact piece is rotated in a contact closing direction by the bias of the spring member in the contact closing direction, and then the open/close movable contact is brought into pressure contact with the open/close fixed contact, and thereafter, after the rotation restriction of the current-passing movable contact piece by the operating piece is released along with the further one-direction movement of the operating element, the current-passing movable contact piece is rotated, and then, the current-passing movable contact is brought into pressure contact with the current-passing fixed contact.

14. The contact mechanism according to claim 13, wherein a lower end portion of a coil spring forming the spring member is brought into contact with an inner surface of a housing in which the pair of movable contact pieces is housed.

15. A trigger switch comprising the contact mechanism according to claim 14.

16. A trigger switch comprising the contact mechanism according to claim 13.

17. An electric tool comprising the trigger switch according to claim 16.

18. The contact mechanism according to claim 13, wherein the operating element comprises:

an operating portion which restricts the open/close movable contact piece to a position where the open/close movable contact is separated from the open/close fixed contact against bias of the spring member in the contact closing direction in a manner such that position restriction is releasable by one-direction movement of the reciprocation movement of the operating element; and an operating piece which restricts rotation of the current-passing movable contact piece in a manner such that rotation restriction is releasable by further one-direction movement of the reciprocation movement of the operating element, and wherein after the operating piece makes the current-passing movable contact piece rotate in a direction opposite to in a contact closing direction along with a restoring operation opposite to the one-direction movement of the operating element, the current-passing movable contact is separated from the current-passing fixed contact, and thereafter, along with a further restoring operation of the operating element, the open/close movable contact piece is rotated against the bias of the spring member by the operating portion of the operating element, and then, the open/close movable contact is separated from the open/close fixed contact.

19. A trigger switch comprising the contact mechanism according to claim 18.

20. An electric tool comprising the trigger switch according to claim 19.

* * * * *